US006949001B1

(12) United States Patent
Brewer, Jr.

(10) Patent No.: US 6,949,001 B1
(45) Date of Patent: Sep. 27, 2005

(54) METHOD AND APPARATUS FOR CLOSING A STUFFED TOY

(76) Inventor: Jimmy D. Brewer, Jr., P.O. Box 2016, Houma, LA (US) 70360

( * ) Notice: Subject to any disclaimer, the term of this patent is extended or adjusted under 35 U.S.C. 154(b) by 423 days.

(21) Appl. No.: 10/278,112

(22) Filed: Oct. 22, 2002

(51) Int. Cl.[7] ..... A63H 3/02
(52) U.S. Cl. ..... 446/369; 294/3.6
(58) Field of Search ..... 446/369–372, 446/472; 294/3.6, 99.2, 26; 24/429, 421, 24/425; 81/488

(56) References Cited

U.S. PATENT DOCUMENTS 97,161 A * 11/1869 Buttles ..... 449/61
2,515,557 A * 7/1950 Haswell ..... 294/3.6
2,845,297 A * 7/1958 Doop ..... 294/3.6
2,900,205 A * 8/1959 Cirone ..... 294/3.6
2,995,865 A * 8/1961 Kiscadden ..... 446/73
3,145,041 A * 8/1964 Grolig ..... 294/3.6
3,354,520 A * 11/1967 Morgen ..... 294/3.6
4,563,159 A * 1/1986 Hills et al. ..... 446/74
5,249,832 A * 10/1993 Leonardz ..... 294/3.6
6,109,196 A * 8/2000 Silber ..... 112/475.08

* cited by examiner

*Primary Examiner*—Bena Miller
(74) *Attorney, Agent, or Firm*—Keeling Hudson, LLC; Kenneth A. Keeling; James E. Hudson, III

(57) ABSTRACT

A method of making a stuffed toy comprises fabricating a container with an elongated opening; attaching a slide fastener having an auto-locking biasing member to the elongated opening; inserting stuffing into said container through said opening; applying a wedge tool to said biasing member to force said biasing member to a released position; closing the opening, and removing the wedge tool from said slide fastener. A wedge tool having a tapered wedge tip is disclosed for operating the sliding member.

12 Claims, 4 Drawing Sheets

METHOD AND APPARATUS FOR CLOSING A STUFFED TOY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention relates generally to clothing and, more particularly, to an apparatus for closing an opening in the skin of a stuffed toy after the toy is filled with stuffing material.

2. Description of the Related Art

Stuffed animals and toys are typically formed by filling a sewn fabric skin with a resilient material such as polyester-cellulose fibers alone or along with polystyrene beads or other filler materials, creating a three-dimensional soft and resilient representation of an animal or other toy.

In some custom manufacturing, an injection tube is inserted through the stuffing opening and the stuffing material is then injected or pumped through the tube into the interior of the stuffed toy.

When the stuffed toy is sufficiently filled with stuffing material, the stuffing opening must be closed. Where possible this has entailed sewing the stuffing opening closed using a sewing machine, which produces an outside ridge which is readily apparent on the skin of the finished stuffed toy. It is desirable to eliminate the need for a sewing machine and to eliminate this ridge. Further, closing the stuffing opening after the stuffing material is inserted can be a relatively time consuming and costly procedure. It is also desirable that the stuffing opening be closed in such a way that considerable time is saved compared to the traditional and costly sewing method.

U.S. Pat. No. 6,109,196 issued to Silber on Aug. 29, 2000 discloses a method of closing that provides openings for stitching, lacing of the stitching filament through the openings prior to stuffing, and pulling the stitching to close the opening after stuffing.

Stuffed objects, such as pillows, are often closed with slide fasteners of a type that can be locked in position, thereby preventing unintended reopening, which would allow stuffing to escape. Various auto-locking slide fasteners are known in the art and include is U.S. Pat. No. 4,081,883 issued April 1978 to Ishii et al., U.S. Pat. No. 139,928 issued Feb. 2, 1979 to Aoki et al., and U.S. Pat. No. 4,422,220 issued December 1983 to Oda, 4,768,263 issued September, 1988 to Fikuroi, et al., U.S. Pat. No. 5,031,286 issued Jul. 16, 1991 to Kudzierski, U.S. Pat. No. 5,884,373 issued Mar. 23, 1999 to Kawamura, U.S. Pat. No. 5,896,628 issued Apr. 26, 1999 to Oda and U.S. Pat. No. 6,314,624 issued Nov. 13, 2001 to Lin. Each of these patents teaches the use of an integral portion of the slide fastener that permits unlocking the slide fastener. Typically, the slide fastener includes a locking member that is biased to a locked position and a fastener pull that forces the locking member to an unlocked position when a distal end of the fastener pull is moved to a determined position.

A slide fastener having an integral lever for unlocking the fastener is not advantageous for a stuffed toy as such opening a fastener would allow a user to readily unlock the fastener, thereby allowing stuffing material to escape.

BRIEF SUMMARY OF THE INVENTION

The present invention overcomes many of the shortcomings of the prior art by providing an improved method for closing the opening used to insert stuffing materials into a stuffed toy. First, fabric members are fastened to make a container, the exterior defining the shape of the toy and an interior volume. The container includes an opening in communication with the interior volume. The opening has a first and a second lip. Two rows of teeth of a slide fastener having an auto-lock function are affixed to the first lip and the second lip such that closure of the slide fastener completely closes the stuffing opening and conceals all or part of the slide fastener and rows of teeth by the first lip and the second lip. The slide fastener used may be of a type which requires an external wedge tool to permit movement. A stuffing apparatus is provided which has an injection tube and a means for propelling a stuffing material through the tube. The injection tube is inserted into the opening between the first and second rows of slide fastener teeth and stuffing material is injected into the interior volume of the container through the tube. The tube is then withdrawn and the slide fastener closed to draw the rows of teeth into abutment. In this way, stuffing is retained in the interior volume.

The present invention further comprises a slide fastener of a type having a self-locking mechanism with a detached instrument for unlocking the fastener, thereby preventing inadvertent opening of the stuffed toy.

DESCRIPTION OF THE INVENTION

Figure 1:
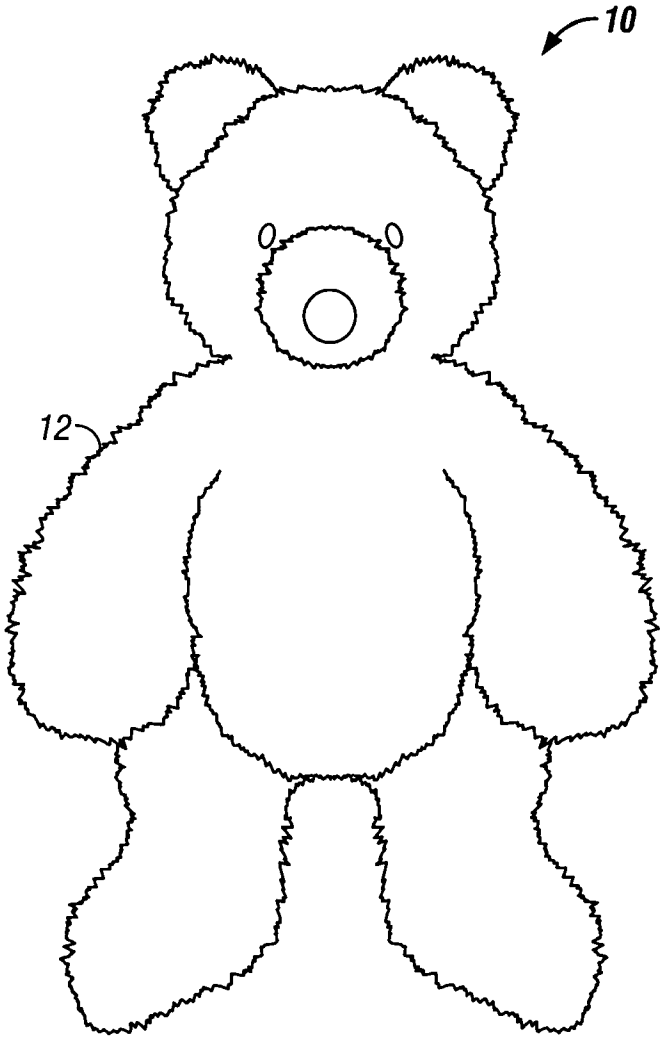
FIG. 1 is a front elevation view of a stuffed toy.

FIG. 1 shows one type of stuffed toy 10, a stuffed bear. Stuffed toy 10 is constructed by filling a sewn fabric container 12, which creates the skin of stuffed toy 10, with a stuffing material 11, which is commonly known in the art. Stuffing opening 13 is left for filling container 12. Container 12 is then filled with stuffing material 11. In the prior art applications, stuffing opening 13 is traditionally sewn shut.

Figure 2:
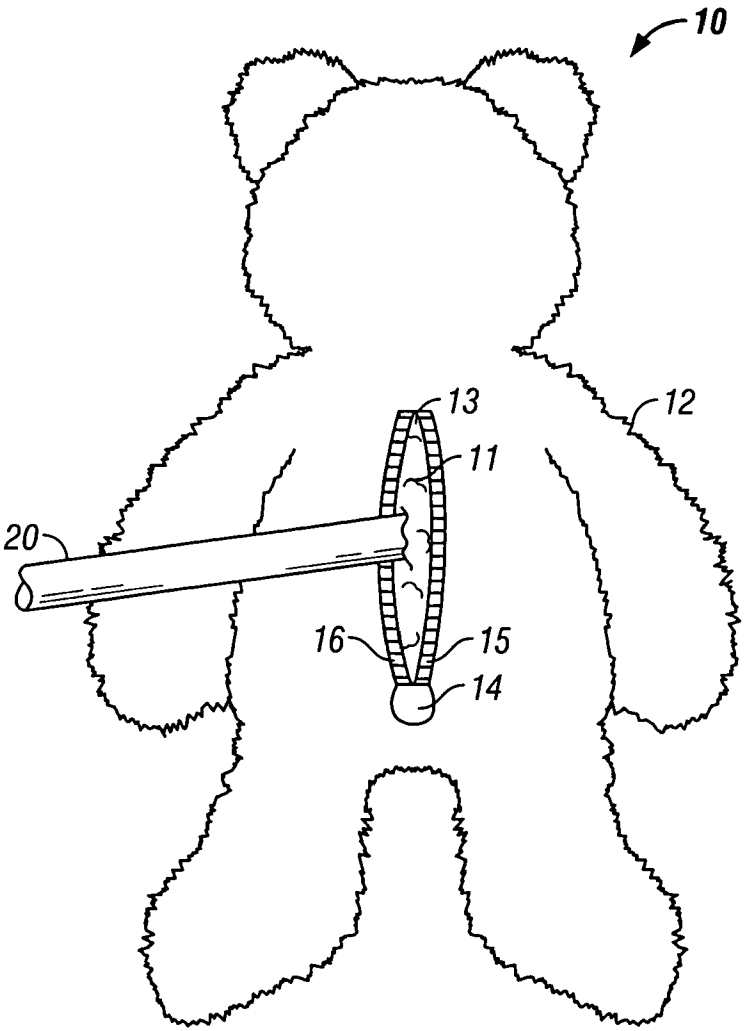
FIG. 2 is a view of a stuffing opening and slide fastener for closing the stuffing opening according to the method of the present invention.

Referring now to FIG. 2, container 12 is filled with stuffing material 11 using an injection tube 20 inserted through the opening 13 from the outside of the container 12 to the inside. Injection tube 20 is part of a stuffing apparatus that includes a device for propelling stuffing material through injection tube 20. As is known to those of skill in the art, injection tube 20 may come in various sizes but is typically in the range of one to four inches in diameter. Stuffing material 11 is injected through the tube 20 into the interior of the container 12 thereby filling the container 12 with stuffing material 11 and filling out the container 12 to a stuffed shape.

Once the container 12 is sufficiently filled with stuffing material 11, the tube 12 is withdrawn from the stuffing opening 13. Opening 13 is then closed by slide fastener 14. As will be clear to one of skill in the art, as the slide fastener 14 is moved, first row of teeth 15 and second row of teeth 16, are brought securely into abutment thereby completely closing the opening 13.

Figure 5:
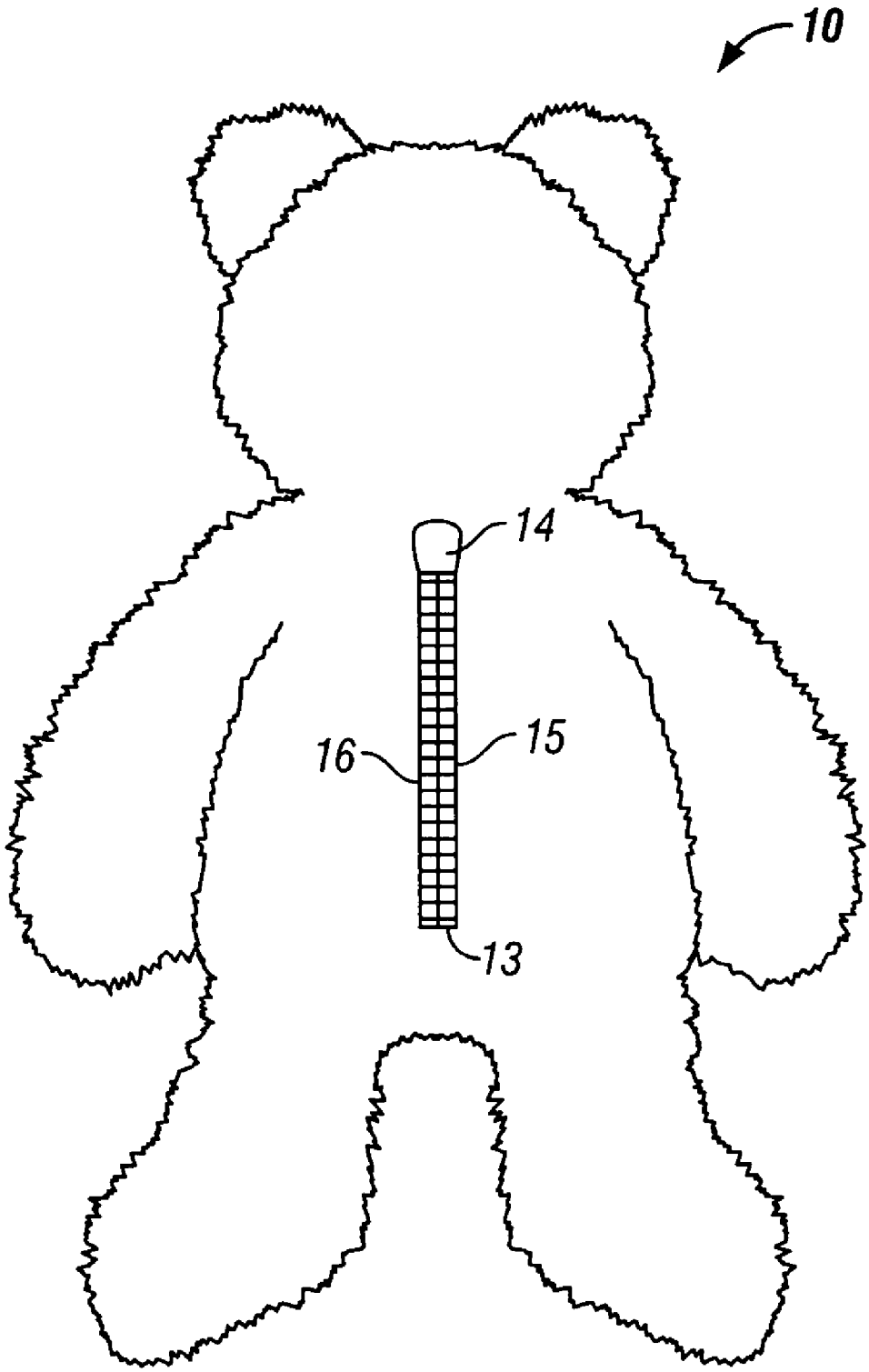
FIG. 5 is a view of the stuffing opening after positioning the slide fastener in the closed position.

Referring now to FIG. 5, the container 12 is depicted after positioning of slide fastener 14 to close stuffing opening 13 with first row of teeth 15 and second row of teeth 16 drawn into abutment.

Slide fastener 14 comprises a type that can be locked in position, thereby preventing unintended reopening, which would allow stuffing to escape. Various auto-locking slide fasteners are known in the art and include fasteners disclosed in U.S. Pat. No. 4,081,883 issued April 1978 to Ishii et al., U.S. Pat. No. 139,928 issued Feb. 2, 1979 to Aoki et al., and U.S. Pat. No. 4,422,220 issued December 1983 to Oda, 4,768,263 issued September, 1988 to Fikuroi, et al., U.S. Pat. No. 5,031,286 issued Jul. 16, 1991 to Kudzierski, U.S. Pat. No. 5,884,373 issued Mar. 23, 1999 to Kawamura, U.S. Pat. No. 5,896,628 issued Apr. 26, 1999 to Oda and U.S. Pat. No. 6,314,624 issued Nov. 13, 2001 to Lin. Each of these patents teaches the use of an integral portion of the slide fastener that permits unlocking the slide fastener.

Figure 6:
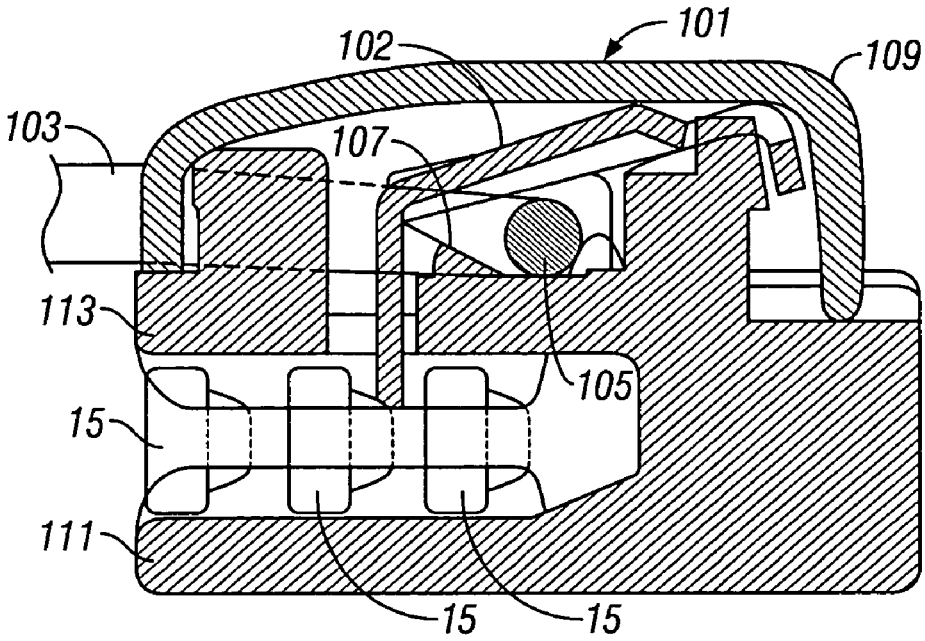
FIG. 6 (Prior Art)
FIG. 6 is a cross-sectional view of a representative prior art slide fastener lock mechanism.

Referring to FIG. 6, a representative prior art sliding fastener 101 is depicted. Fastener 101 includes an upper wing 113, a lower wing 111 and a cover 109. Teeth 15 and teeth 16 (not shown) are joined between upper wing 113 and lower wing 111 when in a fastened position. A leaf spring 102 prevents relative movement of fastener 101 in relation to teeth 15 and 16. In operation, the leaf spring 102 is raised, allowing movement of fastener 101 in relation to teeth 15 and 16 when pull tab 103 is pulled. Such pulling action causes axle 105 of pull tab 103 to slide along guide surface 107 thereby forcing leaf spring 102 to move upward from teeth 15 and 16.

Various other prior art fasteners provide means for biasing a blocking mechanism such as leaf spring 102 against the teeth 15 and 16 and further provide means of disengaging such blocking mechanism by operating a pull tab such as pull tab 103.

Figure 4:
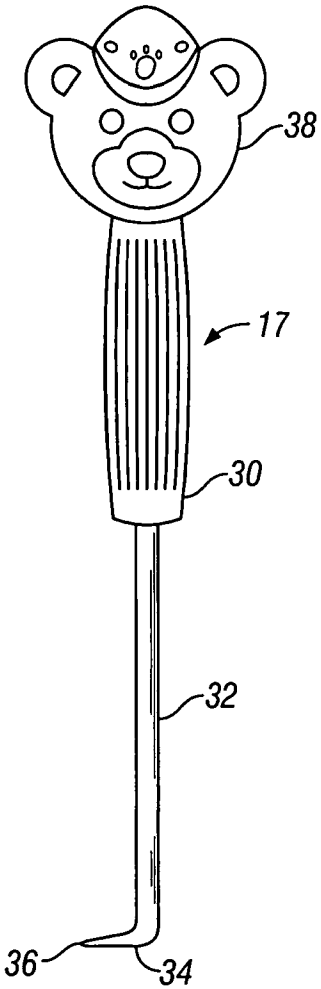
FIG. 4 is a view of the slide fastener positioning wedge tool.

Referring to FIG. 4, wedge tool 17 of the present invention is depicted. Wedge tool 17 includes a wedge tip 34, a handle 30 and a connector rod 32.

Figure 3:
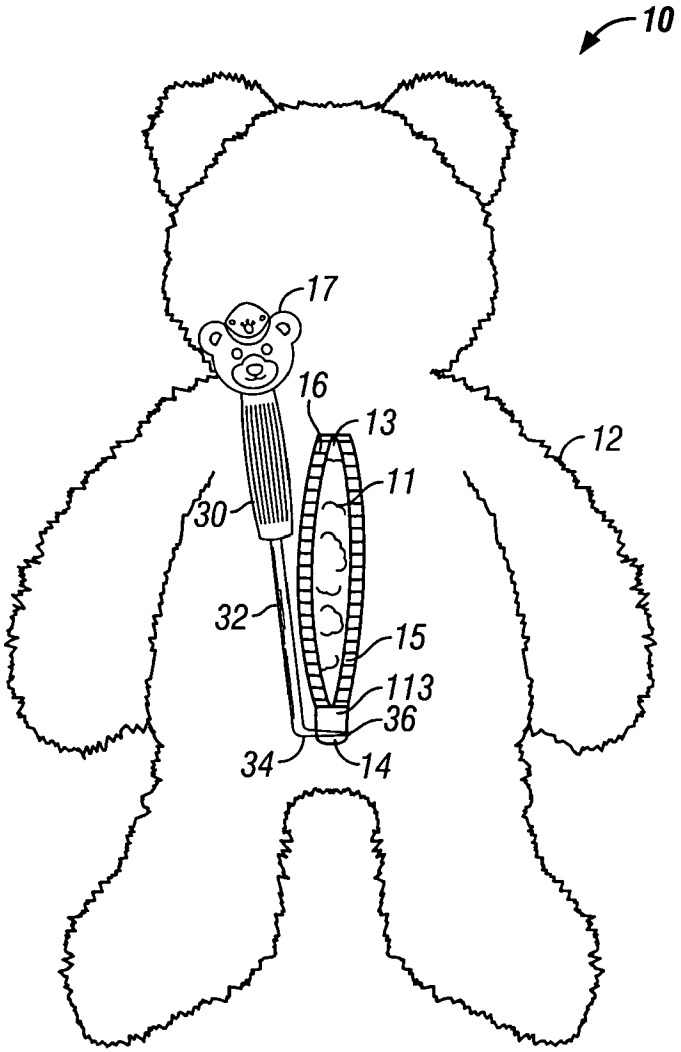
FIG. 3 is a view of a stuffing opening, slide fastener and a wedge tool to position the slide fastener.

Now referring to FIG. 3, the use of wedge tool 17 is shown to draw slide fastener 14 along first row of teeth 15 and second row of teeth 16 to close stuffing opening 13. Wedge tip 34 is inserted between upper wing 113 and lower wing 111 (not shown) of fastener 14, thereby disengaging the blocking mechanism (such as leaf spring 102 of fastener 101) that is otherwise biased against teeth 15 and 16. Wedge tool 17 may thereby be used to move fastener 14 along the rows of teeth 15 and 16, thereby opening and closing stuffing opening 13. When a desired position of fastener 14 is located, the wedge 17 may be removed from fastener 14 allowing the blocking mechanism (not shown) to engage teeth 15 and 16, thereby preventing further movement of fastener 14 in relation to teeth 15 and 16.

Wedge tip 36 is relatively small in relation to a typical pull tab axle. Such relatively small size allows for wedge tip 34 to be readily inserted into an opening in fastener 14 where a pull tab axle would otherwise be placed. The tapered construction of wedge tip 34 between wedge point 36 and connector rod 32 allows for the wedge tip 34 to be slideably inserted between a leaf spring and a segment of the upper wing of a fastener to force the block mechanism away from teeth 15 and 16 while minimizing the transverse forces against the leaf spring.

Effectively, the tapered construction of wedge tip 34 allows for forcing a blocking mechanism such as leaf spring 102 into an open position by inserting the wedge tip transversely to the fastener 14. In conventional fasteners such as fastener 101, the force applied to the blocking mechanism is applied along the axis of the fastener 101.

An effective application of the present invention is to remove a pull tab from a prior art fastener and to use wedge 17 to unlock the blocking mechanism (such as leaf spring 102).

Figure 7:
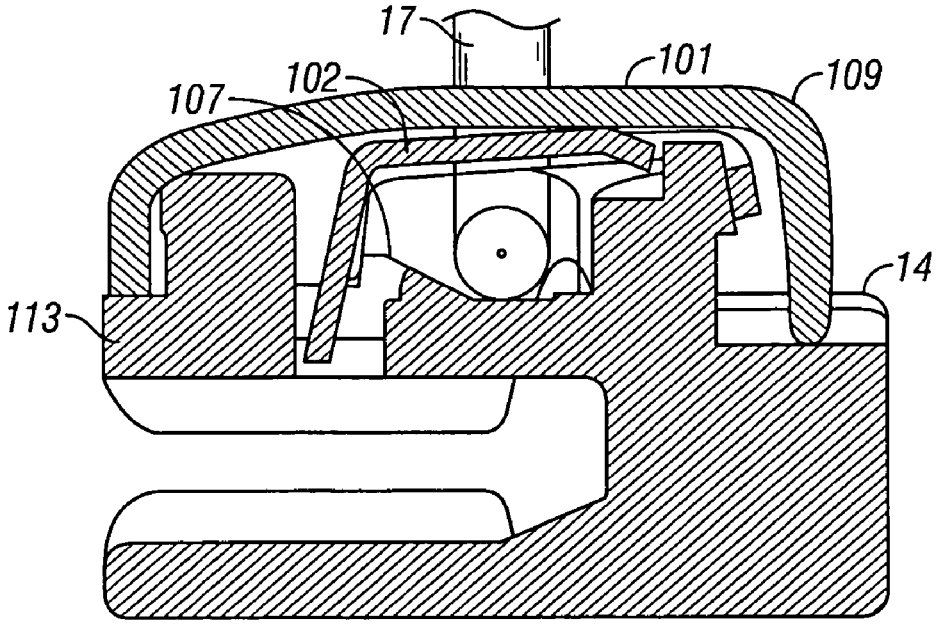
FIG. 7 is a cross-sectional view of a representative prior art fastener with the wedge tool of the present invention.

Referring now to FIG. 7, the operation of the wedge tool 17 of the present invention is shown. A representative prior art fastener 101 is depicted without pull tab 103. Leaf spring 102 would normally be biased against teeth 15 and teeth 16 (not shown). In the depiction of FIG. 7 it may be seen that wedge 17 is inserted into the opening between upper wing 113 and leaf spring 102, thereby forcing leaf spring 102 away from teeth 15 and 16. Wedge 17 may then be pulled by a user to move fastener 101 in relation to teeth 15 and 16, thereby opening and closing the opening 13 as required.

Referring to FIG. 4, the wedge 17 may be provided with a decorative head 38 to associate the wedge 17 with the source of the stuffed toy or animal.

The foregoing drawings, discussion, and description are illustrative of some embodiments of the present invention, but are not meant to be limitations on the practice thereof.

I claim:

1. A method of making a stuffed toy comprising the steps of:

a fabricating step of fastening together a plurality of fabric members so as to define a flexible container having an elongated opening;

a fastener attaching step of attaching fastener teeth to opposed sides of said container opening and attaching a slide fastener having a biasing member for locking said fastener at a fixed position in relation to said fastener teeth;

an inserting step of inserting stuffing into said container through said opening;

a releasing step of applying a wedge tool to said biasing member to force said biasing member to a released position;

a closing step of moving said slide fastener in relation to said fastener teeth to close said opening; and a removing step of removing said wedge tool from said slide fastener.

2. The method of claim 1 wherein:

said releasing step further comprising applying a tapered wedge tip of a wedge tool to said biasing member to force said biasing member to said released position.

3. The method of claim 2 wherein:

said slide fastener having a sliding orientation along said teeth of said elongated opening;

said releasing step further comprising applying said tapered wedge tip transversely to said sliding orientation.

4. The method of claim 1 wherein:

said stuffing step comprising providing a stuffing apparatus having an injection tube and means for propelling a stuffing material though said injection tube; inserting said injection tube into said opening; injecting said stuffing material into a container interior, and withdrawing said injection tube from said opening.

5. The method of claim 1 wherein:

said closing step comprising moving said slide fastener with said wedge tool.

6. The method of claim 1 wherein:

said slide fastener having a sliding orientation along said teeth of said elongated opening;

said releasing step further comprising applying a tapered wedge tip of a wedge tool to said biasing member to force said biasing member to said released position;

said releasing step further comprising applying said tapered wedge tip transversely to said sliding orientation; and said closing step comprising moving said slide fastener with said wedge tool.

7. The method of claim 6 wherein:

said stuffing step comprising providing a stuffing apparatus having an injection tube and means for propelling a stuffing material though said injection tube; inserting said injection tube into said opening; injecting said stuffing material into a container interior, and withdrawing said injection tube from said opening.

8. A method of making a stuffed toy comprising the steps of:

a fabricating step of fastening together a plurality of fabric members so as to define a flexible container having an elongated opening;

a slide fastener attaching step of attaching a slide fastener to said container opening, said slide fastener having a self-locking biasing member and a slide fastener pull tab operable to force said biasing member to a released position;

a pull tab removing step of removing said slide fastener pull tab from said slide fastener;

an inserting step of inserting stuffing into said container through said opening;

a releasing step of applying a wedge tool to said biasing member to force said biasing member, to a released position;

a closing step of moving said slide fastener in relation to said fastener teeth to close said opening; and a removing step of removing said wedge tool from said slide fastener.

9. The method of claim 8 wherein:

said releasing step further comprising applying a tapered wedge tip of a wedge tool to said biasing member to force said biasing member to said released position.

10. The method of claim 9 wherein:

said slide fastener having a sliding orientation along said teeth of said elongated opening;

said releasing step further comprising applying said tapered wedge tip transversely to said sliding orientation.

11. The method of claim 10 wherein:

said stuffing step comprising providing a stuffing apparatus having an injection tube and means for propelling a stuffing material though said injection tube; inserting said injection tube into said opening; injecting said stuffing material into a container interior, and withdrawing said injection tube from said opening.

12. The method of claim 11 wherein:

said closing step comprising moving said slide fastener with said wedge tool.

* * * * *